US005897062A

United States Patent [19]

Enomoto et al.

[11] Patent Number: 5,897,062

[45] Date of Patent: Apr. 27, 1999

[54] FLUID JET NOZZLE AND STRESS IMPROVING TREATMENT METHOD USING THE NOZZLE

[75] Inventors: Kunio Enomoto, Tokai-mura; Katsuhiko Hirano, Hitachi; Masahiro Otaka, Hitachi; Kazuo Amano, Hitachi; Eisaku Hayashi, Hitachi; Sadato Shimizu, Hitachinaka; Ren Morinaka, Hitachi; Kazunori Sato, Kure, all of Japan

[73] Assignees: Hitachi, Ltd.; Babcock-Hitachi Kabushiki Kaisya, both of Tokyo, Japan

[21] Appl. No.: 08/733,926

[22] Filed: Oct. 18, 1996

[30] Foreign Application Priority Data

Oct. 20, 1995 [JP] Japan ..... 7-272285

[51] Int. Cl.[6] ..... B05B 1/00; E21B 7/18

[52] U.S. Cl. ..... 239/590; 239/590.5; 175/67

[58] Field of Search ..... 239/499, 589, 239/590, 590.5, 589.1, 591; 175/67, 424; 299/81.3

[56] References Cited

U.S. PATENT DOCUMENTS

| | | | |
|---|---|---|---|
| 3,713,699 | 1/1973 | Johnson, Jr. | 175/67 X |
| 4,185,706 | 1/1980 | Baker, III et al. | 239/589 X |
| 4,391,339 | 7/1983 | Johnson, Jr. et al. | 239/589 X |
| 4,474,251 | 10/1984 | Johnson, Jr. | 175/67 |
| 4,497,445 | 2/1985 | Adkins et al. | 239/590 |
| 5,178,325 | 1/1993 | Nielson | 239/589 X |
| 5,253,984 | 10/1993 | Gruett et al. | 239/499 X |

*Primary Examiner*—Andres Kashnikow
*Assistant Examiner*—Steven J. Ganey
*Attorney, Agent, or Firm*—Antonelli, Terry, Stout & Kraus, LLP

[57] ABSTRACT

A fluid jet nozzle has a water chamber accommodating therein pressurized fluid, an orifice communicating with the water chamber and contracting the fluid from the water chamber, a throat communicating with the orifice and through which the fluid from the orifice passes, a multiplication chamber communicating with the throat and receiving the fluid from the throat for multiplying cavitation, and a diffusion chamber receiving the fluid from the multiplication chamber for diffusing the fluid.

11 Claims, 7 Drawing Sheets

FLUID JET NOZZLE AND STRESS IMPROVING TREATMENT METHOD USING THE NOZZLE

BACKGROUND OF THE INVENTION

The present invention relates to a liquid jet nozzle for inducing cavitation in a fluid, and a stress improving treatment method using the nozzle.

In apparatus and devices of a nuclear power plant made of austenitic SUS304 stainless steel or Ni base alloy, stress corrosion cracking occurs in some cases. It is well known that such stress corrosion cracking is affected very largely by residual stresses, that is, it is remarkably accelerated in a state of residual tensile stress and is suppressed in a state of residual compressive stress.

Controlling residual stress not only suppresses stress corrosion cracking, but the stress corrosion cracking can be prevented by changing the residual tensile stress to residual compressive stress.

Further, the residual stress improvement serves not only for stress corrosion cracking resistance but for prevention of damage due to corrosion, fatigue, corrosion fatigue, etc.

Therefore, in a nuclear power plant, it is important to improve the stress by changing the residual tensile stress caused in welded portions of an apparatus and various devices to residual compressive stress.

A metal surface strengthening method is disclosed in JP A 59-193215, wherein residual tensile stress caused by working, such as welding, is reduced by causing residual compressive stress to occur on a surface of a metal material, thereby to prevent damage, such as stress corrosion, corrosion, fatigue, corrosion fatigue, etc.

This method is designed to strengthen metal by peening, that is, by causing cavities to be produced in liquid by jetting liquid at high pressure and high velocity from a nozzle onto the metal submerged in the liquid and utilizing the collapse impact force of the cavities to apply a force to the metal.

A nozzle for jetting liquid at high pressure and high speed is disclosed in JP A 59-25681.

JP A 59-25681 discloses a submerged jet nozzle which is provided with an orifice having a section in the shape of a circle, an ellipse or a rectangle, and which has a diffusion chamber disposed downstream of the orifice and expanding at an angle of 20–60° with respect to the axis of the orifice, in order to increase the submerged jet flow.

JP A 59-25681 also discloses that the length of a jet hole extending from the orifice is 4 to 20 times the diameter of the orifice, and this construction reduces the flow velocity loss of the submerged jet flow and can cause the jet flow to reach a more remote area.

However, JP A 59-193215 does not disclose any specific means for jetting liquid of high pressure and high speed.

On the other hand, JP A 59-25681 has an object to suppress decay of the jet flow, and does not disclose any means for obtaining jet flow with cavitation.

Thus, in the prior devices, in order to achieve a sufficient effect, it is essential to shorten the distance (jet distance) between the nozzle and an object to be treated, and it is difficult to attain a peening effect in a case where the jet distance is long and in a case where decay in the jet flow velocity is remarkably large, as in a submerged jet, even if the jet distance is short.

In jetting in the atmosphere, the jet velocity decay is small, however, it is required to raise the jet pressure to a super high pressure in JP A 59-25681 in which only an impingement dynamic pressure is used. Therefore, the apparatus is disadvantageous also in performance and in the cost of a pump, and relevant apparatuses.

SUMMARY OF THE INVENTION

A first object of the present invention is to provide a jet nozzle which is suitable for use in a stress improving treatment method which promotes, more than in a conventional method, the occurrence of cavitation bubbles contributing to generation of residual compressive stresses on a metal material surface by causing jet flow jetted from the jet nozzle to impinge on the surface.

A second object of the present invention is to provide a stress improving treatment method which uses such a jet nozzle.

A first aspect of the invention for achieving the first object involves provision of fluid jet nozzle which comprises a water chamber accommodating therein pressurized fluid, an orifice communicating with the water chamber and contracting the fluid from the water chamber, a throat communicating with the orifice and through which the fluid from the orifice passes, a multiplication chamber communicating with the throat for receiving the fluid from the throat for multiplying cavitation, and a diffusion chamber receiving the fluid from the multiplication chamber for diffusing the fluid.

A second aspect for achieving the first object of the present invention is characterized in that the multiplication chamber is a cup-like shaped multiplication chamber which has an upstream end opening having a radius which is equal to or larger than the radius of the throat, a downstream end opening of which the radius is equal to or larger than the radius of an upstream end opening of the diffusion chamber, and a section shaped in a cup-like shape contoured by a convex curve expanded toward the outside between the upstream end opening and the downstream end opening, and wherein the diffusion chamber is a conical diffusion chamber.

A third aspect for achieving the first object of the present invention is characterized in that the cup-like shaped multiplication chamber is a maximum value cup-like shaped multiplication chamber which has a sectional shape contoured by a convex curve expanded toward the outside between the upstream end opening and the downstream end opening, the convex curve having a maximum value therebetween.

A fourth aspect for achieving the first object of the present invention is characterized in that a plurality of conical diffusion chambers having different apex angles, respectively, are formed downstream of the throat, the conical diffusion chambers serving as a multiplication chamber and a diffusion chamber.

A fifth aspect for achieving the first object of the present invention is characterized in that the throat has an inner surface formed in an annular concavo-convex shape, a parallel thread shape or a tapered thread shape, thereby to provide a cavitation kernel excitor.

A sixth aspect for achieving the first object of the present invention is a fluid jet nozzle which comprises a water chamber accommodating therein a pressurized fluid, an orifice communicating with the water chamber for contracting the fluid from the water chamber, a throat communicating with the orifice and through which the fluid from the orifice passes, a cavitation kernel excitor constructed in an annular concavo-convex shape, with parallel threads or tapered threads, formed in the inner surface of the throat, and a diffusion chamber communicating with the throat and receiving the fluid,from the throat for diffusing the fluid.

A seventh aspect for achieving the first object of the present invention is characterized in that the fluid jet nozzle is an assemblage of a portion, including the throat and an upstream side construction of the throat, a portion of the multiplication chamber and a portion of the diffusion portion.

An aspect for achieving the second object of the present invention involves the provision of a stress improving treatment method which generates compression plastic deformation and residual compressive stress in a surface layer of a metal member disposed in a fluid by causing fluid jetted from a fluid jet nozzle in the fluid and including cavitation bubbles to impinge on the surface of the metal member, characterized in that a fluid jet nozzle in accordance with the present invention is used as the fluid jet nozzle.

DESCRIPTION OF EMBODIMENTS OF THE INVENTION

Figure 1:
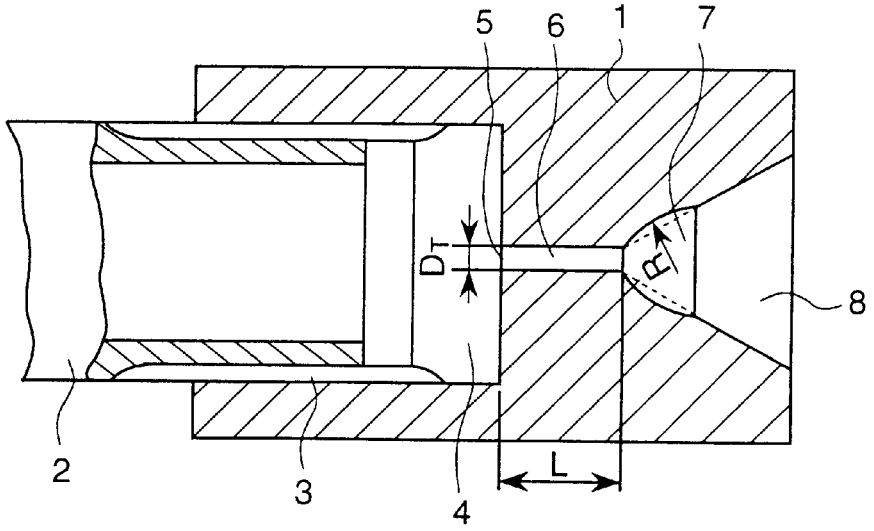
FIG. 1 is a sectional view of a nozzle forming a first embodiment of the present invention.

FIG. 1 shows a section of a pressurized water jet nozzle 1 forming a first embodiment of the present invention.

The pressurized water jet nozzle 1 comprises a connection portion 3 connecting a conduit 2 for supplying pressurized water, which has been raised in pressure by a pump, a water chamber 4 which extends from the end of the conduit 2, an orifice 5 communicating with the water chamber 4, a throat 6 communicating with the orifice 5, a multiplication chamber 7 communicating with the throat 6 for generating and multiplying cavitation, and a conical diffusion chamber 8 communicating with the multiplication chamber 7 and having an apex angle of 30–120°. In FIG. 1, $D_T$ and L represent the diameter and length of the throat 6, respectively.

The sectional shape of the multiplication chamber 7 is a cup-like shape as represented by a convex curved line expanded outside of an extension line (broken line) of the contour of the conical diffusion chamber 8. The convex curve is preferably in the form of a partial ellipse or partial circle. In the present embodiment, it is shaped into a partial circle of a radius R in view of the easiness of working the material to form this shape.

The length L of the throat 6 is $L \leqq 4D_T$, and the radius R of the curve of the cup-like shaped multiplication chamber 7 is $R=D_T\times(1–10)$.

Figure 2:
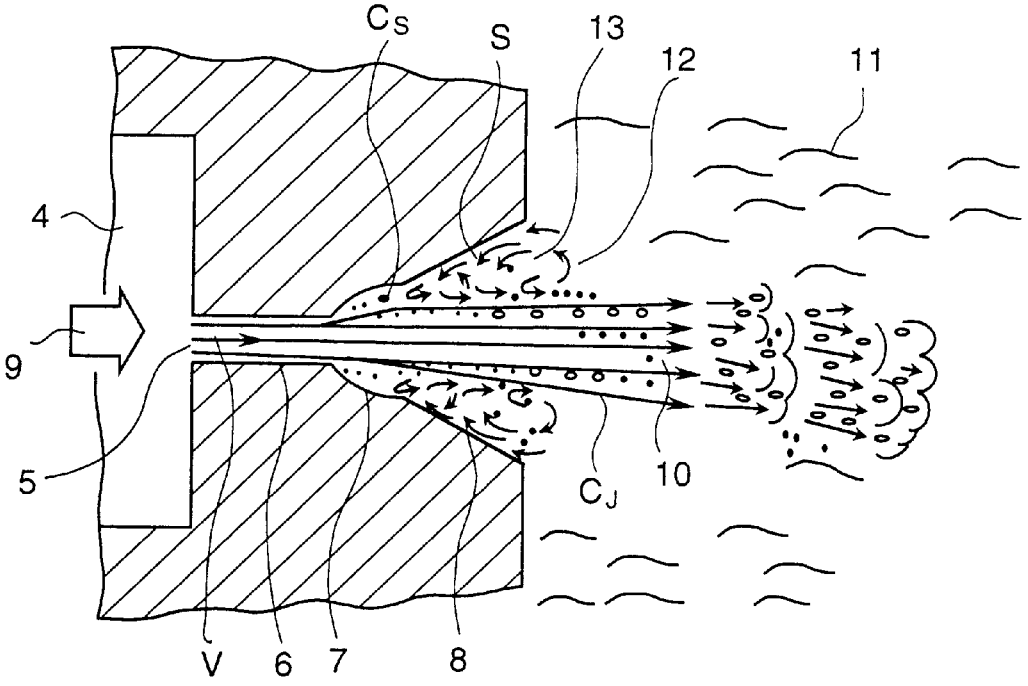
FIG. 2 is a sectional view of a part of the nozzle of FIG. 1, showing a jetted state of fluid by the nozzle in water.

The operation and effect of the present embodiment will be explained hereunder with reference to FIG. 2.

Pressurized water 9 supplied to the water chamber 4 through the conduit 2 is contracted by the orifice 5. The contracted water passes through the throat 6 at a velocity V, and then it is jetted as a jet water 10 into the surrounding water 11 from the multiplication chamber 7 downstream of the throat 6.

The water jet causes a lot of eddied or convection currents 12 in a gap S between a wall surface of the conical diffusion chamber 8 and the water jet 10, and here cavitation kernels 13 are generated. A part of the generated cavitation kernels 13 are carried on to the cup-like shaped multiplication chamber 7 by the swirling convection 12 and are stored there. However, when the cavitation kernels stored there reach a certain amount, they are carried on the water jet 10 and are discharged intermittently and explosively toward the downstream side out of the nozzle.

Therefore, the stored cavitation kernels 13 are added to the cavitation kernels discharged without being stored, so that the fluid, including a lot of cavitation kernels of high density, flows out. Thus, the metal on which the fluid outflow impinges is subjected to a strong peening in a short time.

In this case, since the cup-like multiplication chamber 7 has an outlet for pressurized water which is wider than the inlet thereof, the multiplication chamber 7 is imparted with a function of diffusing the pressurized water from the throat 6. The diffusion function of the multiplication chamber 7 is added to the diffusion function of the diffusion chamber 8, whereby the jet of water jetted from the nozzle can be more widely diffused than would occur from a conventional nozzle, and so peening over a wide region can be effected in a short time.

The cup-like multiplication chamber 7 serves as a growth chamber for the cavitation kernels 13 and as a storage for the this produced cavitation kernels.

Further, since the throat length L is shortened to be $L \leqq 4D_T$, the flow is contracted by the orifice 5 so that it is increased in velocity to a velocity V and is jetted into the diffusion chamber with a turbulent flow without being rectified, so that generation of the cavitation kernels becomes active.

If the throat length L is long, that is, if $L \geqq 4D_T$, flow in the throat is rectified, however, the flow velocity itself becomes larger because of an increase in the frictional loss.

Therefore, the pressure P of high pressure water 9 has to be increased corresponding to the frictional loss in order to make the outlet velocity of the flow at the outlet of the throat 6 higher. In other words, when a jet nozzle is taken as a standard, in which the throat length is long such as $L \geqq 4D_T$, the nozzle according to the present invention can attain an effect equal to or greater than a nozzle in which the throat is long, even if the pressure P of pressurized water is low.

Figure 3:
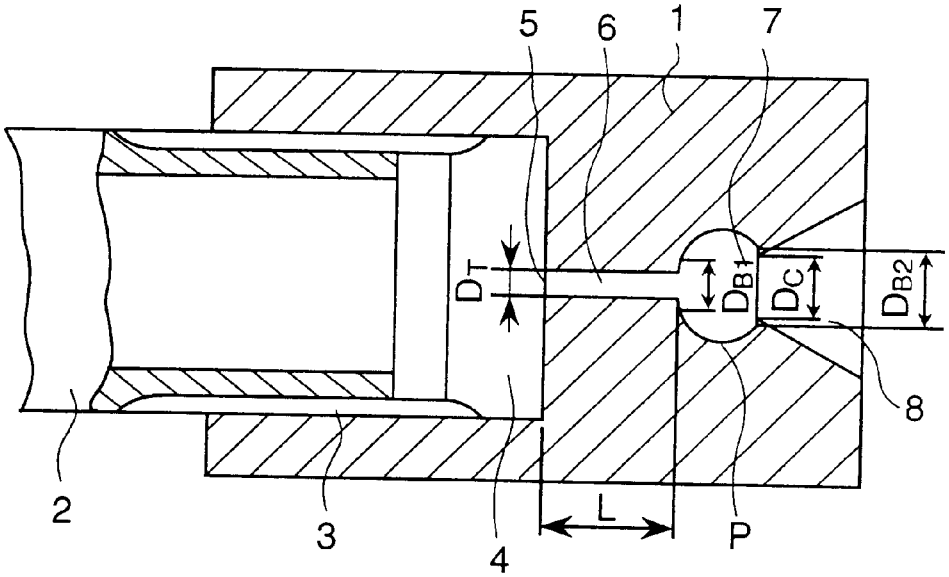
FIG. 3 is a sectional view of a nozzle forming a second embodiment of the present invention.

FIG. 3 shows a section of a pressurized water jet nozzle 1 forming a second embodiment of the present invention.

In this embodiment, the diameter ($D_{B1}$) of an upstream end of a multiplication chamber 7 communicating with the throat 6 is set to be $D_{B1}>D_T$, and the diameter ($D_{B2}$) of the downstream end of the multiplication chamber 7 is set to be larger than the diameter ($D_C$) of the upstream end of a conical diffusion chamber 8, that is, $D_{B2}>D_C$.

Further, the sectional shape between the upstream end and the downstream end of the multiplication chamber 7 is formed so a to be contoured in the form of a convex curve, expanded toward the outside and having a maximum value P, as shown in FIG. 3.

The features of the present embodiment which are different from the first embodiment reside in the fact that the multiplication chamber 7 has a deep recess with a maximum value P, whereby it is easier for cavitation to stay or be stored therein, and that rapid change in the shapes of transitional portions from the throat 6 to the multiplication chamber 7 and from the multiplication chamber 7 to a conical diffusion chamber 8 make conditions more active to generate cavitation kernels 13.

By these features, it is possible to explosively discharge much more active cavitation.

As an example of the present embodiment, it is possible for $D_{B1}\approx D_T$ and $D_{B2}\approx>D_C$ although illustration thereof is omitted. By constructing the nozzle in this manner, the operation of the nozzle does not change, but production working of the nozzle becomes easy.

The other aspects of the construction, operation and effect, other than the above-mentioned differences, are the same as in the first embodiment.

Figure 4:
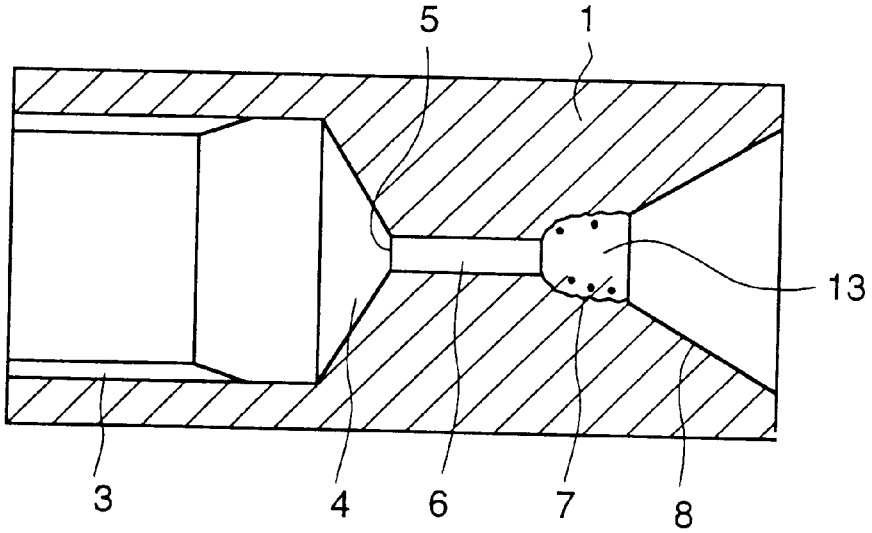
FIG. 4 is a sectional view of a nozzle forming a third embodiment of the present invention.

FIG. 4 shows a third embodiment of the present invention.

The differences between the present embodiment and the first embodiment reside in the fact that a connecting portion between the water chamber 4 and the throat 6 is formed in a tapered shape from the water chamber 4 to the orifice 5 to provide a smooth transitional portion with less pressure loss therein, and the wall of the cup-like shaped multiplication chamber 7 is made finely concavo-convex.

The provision of a finely concavo-convex wall surface makes it easy to store or retain therein cavitation kernels 13, and the stored cavitation kernels 13 can be more strongly and explosively discharged.

The other aspects of the construction, operation and effects are the same as in the first embodiment.

Figure 5:
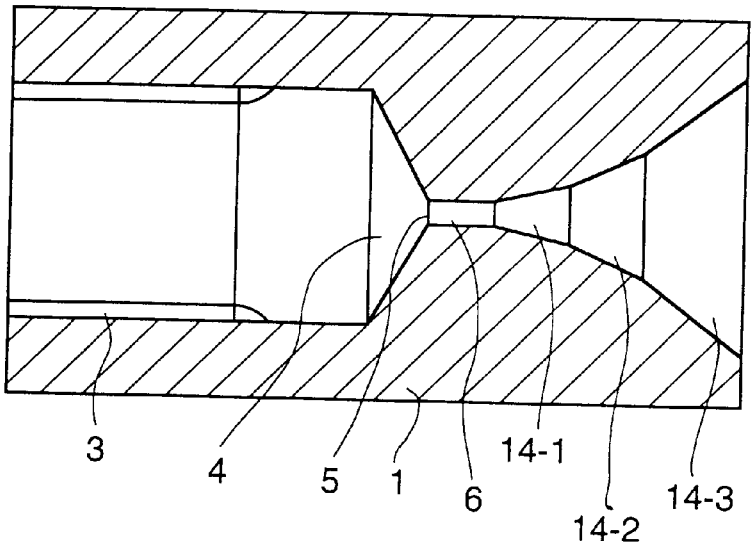
FIG. 5 is a sectional view of a nozzle forming a fourth embodiment of the present invention.

FIG. 5 shows a fourth embodiment of the present invention.

Figure 6:
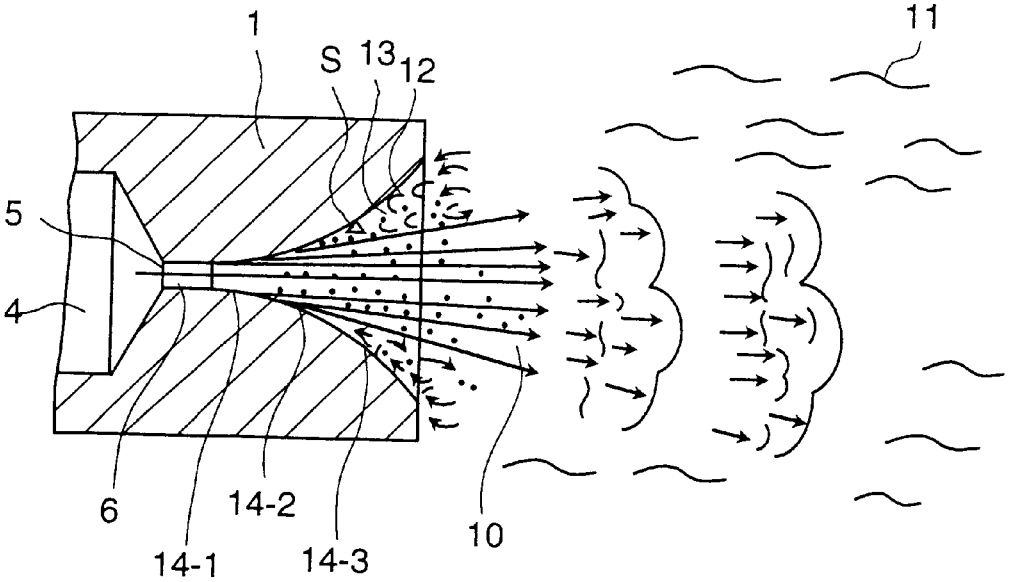
FIG. 6 is a sectional view of a part of the nozzle of FIG. 5, showing a jetted state of fluid by the nozzle in water.

In FIG. 5, the sectional shape of a pressurized water jet nozzle of the present embodiment is shown, and FIG. 6 is for explanation of the effects of the nozzle of this embodiment.

A difference between this embodiment and the first, second and third embodiments is that there is provided a conical diffusion chamber which is formed in multi-steps or multi-stages spreading in multi-steps at different apex angles 10 to 120° from the throat 6 to provide a cavitation kernel exciter.

In this embodiment, a conical diffusion chamber having these steps 14-1, 14-2, 14-3 is provided. A water jet 10 jetted from an outlet of the throat 6 causes convection 12 in a gap S between the wall surface of the three step conical diffusion chamber and the water jet 10 so as to generate cavitation kernels 13.

A part of the generated cavitation kernels 13 are conveyed to rapid angle change portions between the throat 6 and the chamber part 14-1 of the conical diffusion chamber, the chamber part 14-1 and a chamber part 14-2, and the chamber parts 14-2 and 14-3, and are stored there.

When the number of stored cavitation kernels reaches a fixed amount, they are carried on the water jet 10 and intermittently and explosively discharged toward the downstream side. Portions at which diffusion rapidly changes have a function of retaining the cavitation.

The features of this embodiment reside in the fact that the water jet 10 contains cavitation uniformly from a central portion of the water to the peripheral portion, the water jet spreads widely to enable wide jetting and the nozzle can be easily produced.

The other features are the same as in the above-mentioned embodiments.

Figure 7:
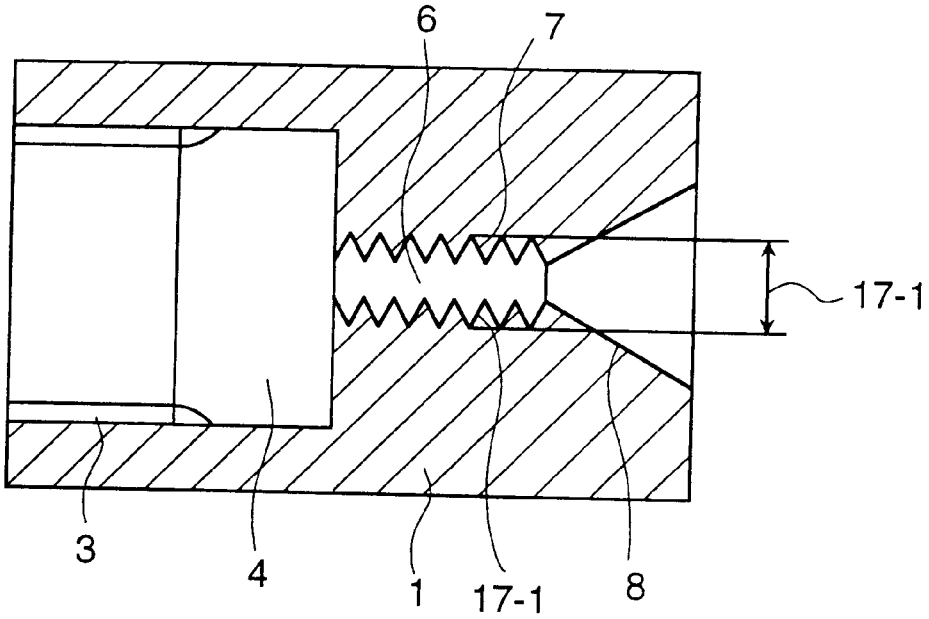
FIG. 7 is a sectional view of a nozzle forming a fifth embodiment of the present invention.
Figure 8:
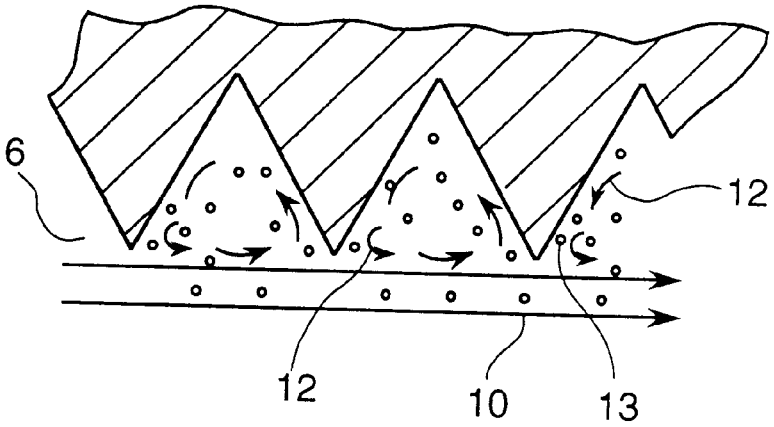
FIG. 8 is an enlarged sectional view of a part of the nozzle of FIG. 7, showing a convection in a state of fluid passing through the nozzle.

FIG. 7 shows a sectional shape of a pressurized water jet nozzle 1 forming a fifth embodiment, and FIG. 8 is for explanation of the operation and effects of the nozzle of this embodiment.

In this embodiment, the inner surface of the throat 6 is made in an annular concavo-convex shape 17 to have the form of a parallel thread 17-1, which is easily produced. The throat 6 is a cavitation kernel exciter.

In operation and effect, the convection 12 occurs between a thread and an adjacent thread, as shown in FIG. 8. Cavitation kernels 13 generated here are caught by the water jet 10, so that the water jet 10 containing a lot of cavitation kernels 13 can be jetted. Upon jetting, since the water jet passes through the diffusion chamber 8, the water jet is diffused widely.

Further, since the throat 6 is shaped as a screw thread, a resistance which is applied to the water jet 10 in the throat 6 is produced by only the apex portions of the threads. Therefore, the frictional loss becomes small, and the same effect is obtained as described with reference to the frictional loss reduction produced by shortening the throat length in the embodiment of FIG. 1.

Therefore, peening can be effected by a large number of cavitation kernels in a short time.

Figure 9:
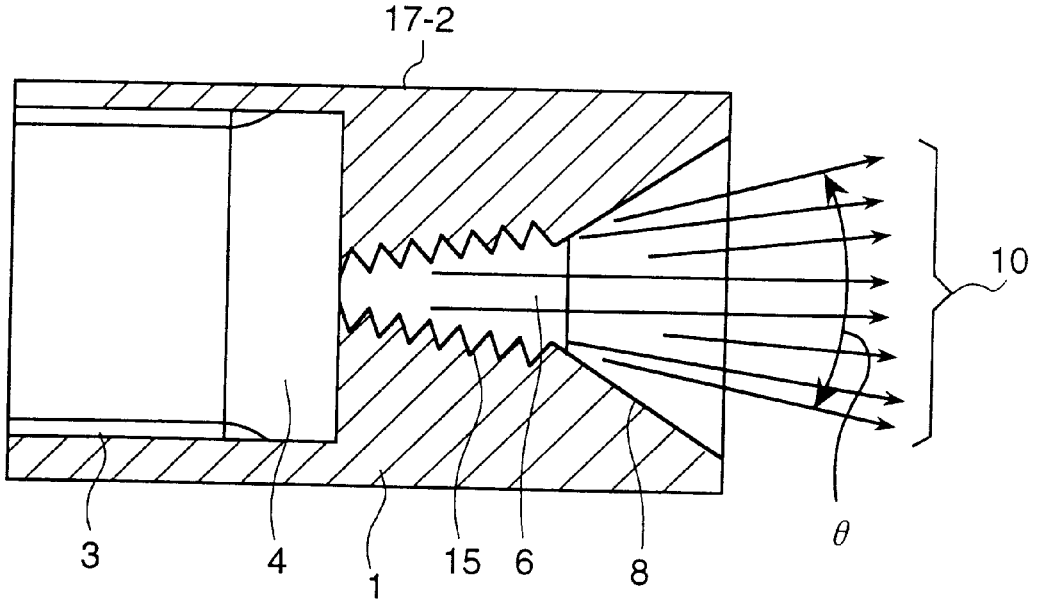
FIG. 9 is a sectional view of a nozzle forming a sixth embodiment of the present invention.

FIG. 9 shows a sectional shape of a pressurized water jet nozzle 1 forming a sixth embodiment.

A difference between of this embodiment and the fifth embodiment shown in FIG. 8 is that the throat 6 has an inner surface formed in the annular concavo-convex shape of a tapered screw thread 17-2 to provide a cavitation kernel excitor. A feature of this embodiment is that the frictional loss reduction effect is further increased, in addition to the effect of the embodiment of FIG. 8, and also wider jetting is possible because the spreading angle θ of water jet 10 is expanded.

Although embodiments having an angular concavo-convex shape have been explained with reference to FIGS. 7 and 9, the same effect may be obtained by an annular concavo-convex shape 17 which is not formed by a spiral shape as a screw, but which is formed in multi-annular parallel grooves.

Figure 10:
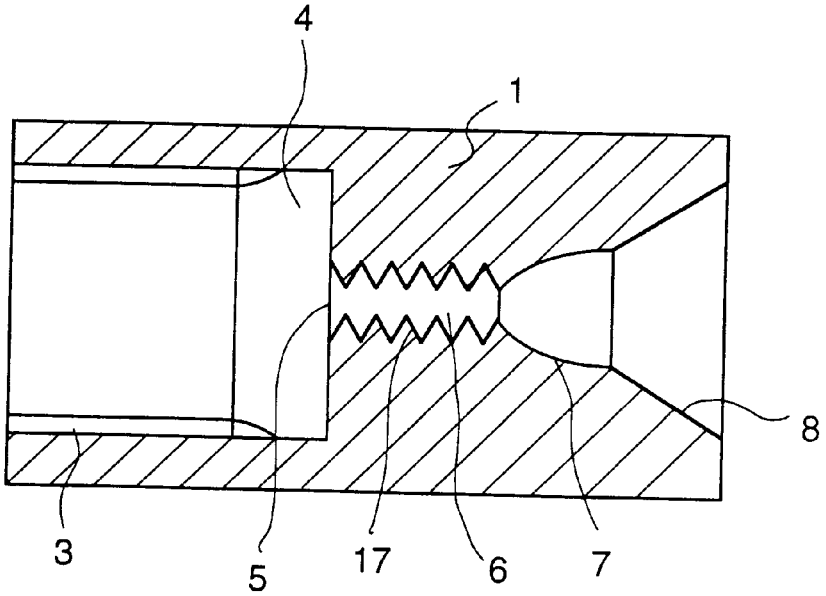
FIG. 10 is a sectional view of a nozzle forming a seventh embodiment of the present invention.

FIG. 10 shows a sectional shape of a pressurized water jet nozzle 1 forming a seventh embodiment.

The pressurized water jet nozzle 1 comprises an orifice 5, a throat 6 communicating with the orifice 5 having an annular concavo-convex inner wall 17 satisfying the relation $L\leqq 4D$, a cup-like shaped multiplication chamber 7 communicating with the throat 6 and a conical diffusion chamber 8 communicating with the cup-like shaped multiplication chamber 7.

According to this embodiment, in addition to the resistance reducing effect of the throat length, the effects produced by the concavo-convex surface 17 of the throat 6 and the cup-like shaped multiplication chamber 7 can be attained at the same time.

In this embodiment, in addition to the resistance operation and effects of the first embodiment, since the annular concavo-convex cavitation excitor is provided in the inner surface of the throat 6, an even large number of cavitation kernels can be easily generated, and peening can be achieved in a short time.

Although a specific explanation has been omitted, various combinations of the conical diffusion chamber, for example, the three step conical diffusion chamber with the other part of the nozzle, instead of the cup-like shaped multiplication chamber 7 of this embodiment, can be employed, and an additive effect of each part of each combination can be attained.

Figure 11:
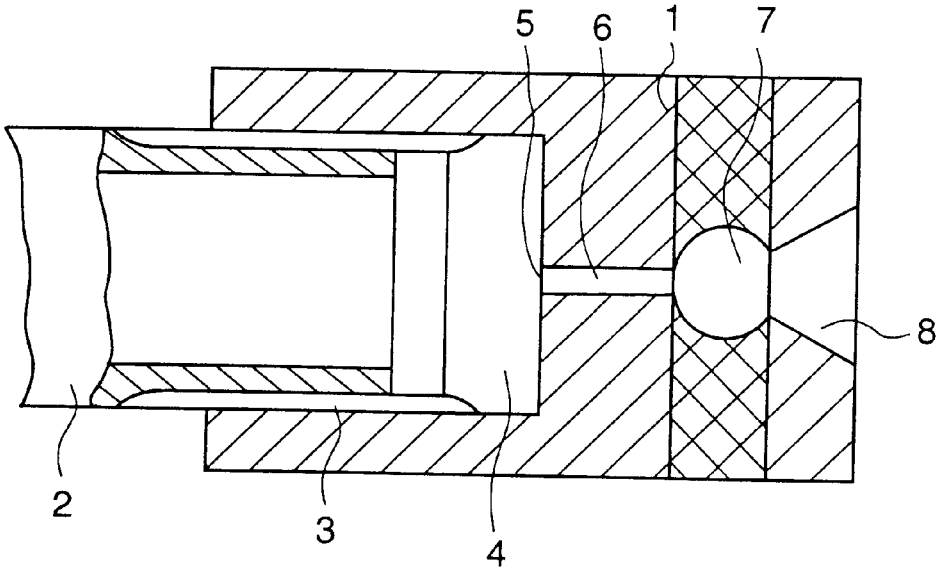
FIG. 11 is a sectional view of a nozzle forming an eighth embodiment of the present invention.

FIG. 11 shows an eight embodiment.

In this embodiment, a pressurized water jet nozzle 1 is formed as a three division structure in view of ease of manufacture, and the three divisions are assembled to form a complete nozzle, without utilizing a one piece structure as described in the above-mentioned embodiments.

An example is as follows. That is, the nozzle 1 is divided into three portions, including an upstream portion upstream of the throat 6, a multiplication chamber portion 7, and a diffusion chamber portion 8. The three portions are assembled by any desirable means, such as welding or with fastening means, to form an integrated nozzle 1.

In this embodiment, the nozzle can be very easily produced with a high precision. Therefore, the above mentioned cavitation multiplication and growth properties can be easily attained.

Figure 12:
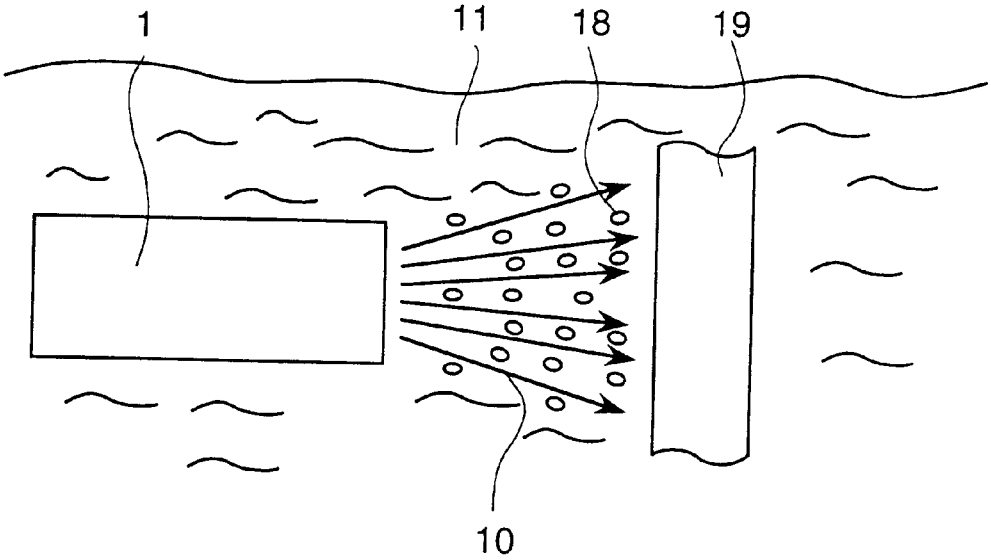
FIG. 12 is a diagrammatic view showing the use of a nozzle of the present invention to effect treatment of an object in water.

FIG. 12 shows an example of a use for the present invention.

In FIG. 12, a stress improving treatment is shown, wherein high velocity water jet 10, jetted from the pressurized water jet nozzle 1 as described in the above-mentioned various embodiments and containing therein cavitation bubbles 18, is caused to impinge on a surface of a metal member or body 19 submerged in the surrounding water 11.

As described above, by causing the water jet 10 jetted from the pressurized water jet nozzle 1 to impinge on the surface layer of the metal member 19, the cavitation bubbles are broken on the surface of the metal member 19. At this time, higher pressure than the yield stress of the metal member 19 occurs due to water hammer caused by the brakeage of the bubbles, so that the surface layer is plastically deformed so as to be extended. However, a portion right under the surface layer and a surrounding portion are within the bounds of elastic deformation, so that these portions serve to shrink and restore the deformation portion to its original position.

Therefore, residual compressive stress is induced at the surface of the metal member 19 on which the cavitation bubbles impinge and are broken. That is, by performing a stress improving treatment using the nozzle according to the present invention, compression plastic deformation and residual compressive stress can be generated effectively on the surface layer of the metal member 19.

Namely, when a stress improving treatment is carried out, cavitation kernels and cavitation bubbles grown from the cavitation kernels, which contribute to residual compressive stress, can be generated to a larger degree by using the nozzle according to the present invention rather than by using a conventional nozzle, with the result that the residual stress can be improved in a short time, and various properties, such as stress corrosion resistance, fatigue characteristic, corrosion fatigue characteristic, can be attained in a short time.

Figure 13:
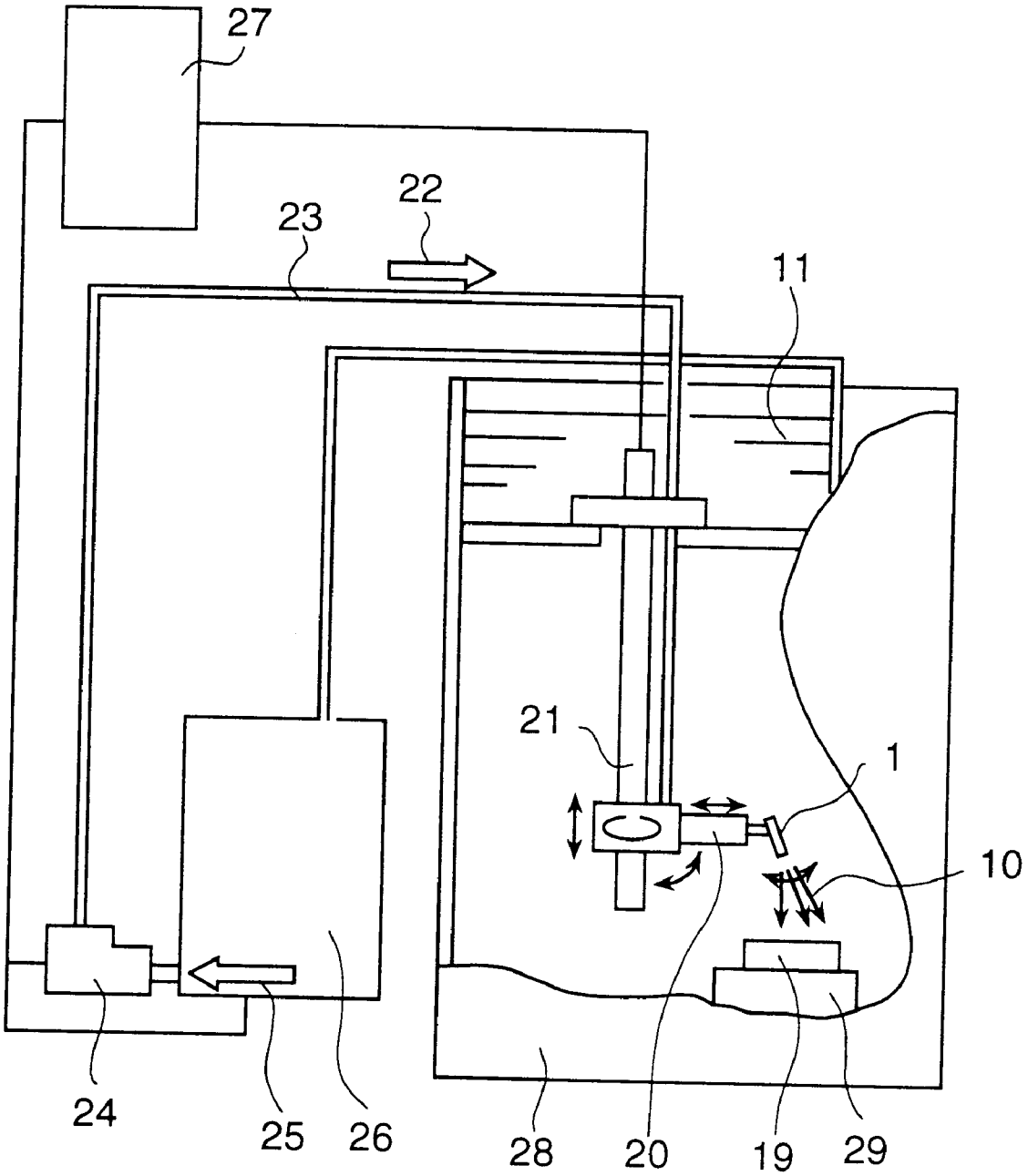
FIG. 13 is a schematic diagram showing the whole of a stress improving treatment apparatus incorporating the features of the present invention.

FIG. 13 shows a an overall view of a stress improving treatment apparatus.

This is a pressurized water jet apparatus 29 for effectively generating compression plastic deformation and residual compressive stress on a surface layer of a metal member or body 19, using the pressurized water jet nozzle 1 according to any of the above-mentioned embodiments.

The pressurized water jet apparatus 29 comprises an arm 20 to which the pressurized water jet nozzle 1 of any above-mentioned embodiment is mounted swingably at one end, a drive apparatus 21 for driving the arm 20 to rotate and move up and down, right and left, a feed pipe 23 for feeding high pressure water 22 to the nozzle 1, a high pressure pump 24, a feed water tank 26 having the function of purifying the feed water 25 and adjusting the water quality, a water bath 28 provided with a support 27 for holding a metal member 19, and a controller 27 for controlling the arm 20, the drive apparatus 21, the high pressure pump 24, and the feed water tank 26.

In the pressurized water jet apparatus, pressurized water is jetted in the following manner. First of all, a metal member 19 is mounted on the support 29 in the water bath 28, and the controller 27 is set so that the pressurized water jet nozzle 1 can move while keeping proper distance and direction between the metal member 19 and the nozzle 1. Next, the high pressure pump 24 is started, and then the jet pressure is set to about 20 MPa–100 MPa, and peening is started.

The pressurized water jet nozzle 1 generates a water jet 10 including cavitation bubbles on the surface of the metal member 19 while running, traversing, swinging and revolving according to a predetermined set pattern.

On the surface of the metal member 19 jetted, the same stress improving treatment as described with reference to FIG. 12 is effected.

Further, assuming that the water bath 28 is a nuclear reactor pressure vessel or shroud, the pressurized water jet apparatus can be employed as an apparatus for a nuclear reactor.

In this case, the surrounding water is reactor water in the nuclear reactor pressure vessel, reactor water or pure water prepared separately being used as feed water.

In a case wherein the reactor water is used as feed water, the feed water tank 26 is provided with a jet water recovery means for sucking up jet water jetted into the nuclear reactor pressure vessel and a means for purifying the recovered water and adjusting the quality of the water, although these elements are not illustrated.

According to the invention, since a lot of active cavitation bubbles are contained in the jet water, an effect of generating residual compressive stress on the metal surface is high, so that it is possible to effectively prevent damage, such as stress corrosion cracking, corrosion fatigue, fatigue, etc. in a short time. Further, since the diffusion angle of the jet water can be widened, residual stress improvement in a wide range can be effected by the jetting, so that the workability is higher and the work can be finished in a short time.

In particular, when it is applied to a nuclear reactor, even after the operation is started, residual tensile stress in welded portions of apparatuses and constructions in the reactor can be easily converted into residual compressive stress under the condition that the apparatuses and constructions are assembled without disassembling them and under the condition that reactor water is filled in the reactor.

According to the nozzle of the present invention, it is possible to cause a lot of cavitation bubbles to be introduced in the jet water from the nozzle.

According to the stress improving treatment method of the present invention, stress improving treatment can be effected in a short time.

What is claimed is:

1. A fluid jet nozzle, comprising:

a liquid chamber accommodating therein pressurized liquid;

an orifice communicating with said liquid chamber and through which the liquid from said liquid chamber passes;

a throat communicating with said orifice and through which the liquid from said orifice passes;

a multiplication chamber communicating with said throat and receiving the liquid from said throat for multiplying cavitation in the liquid; and a diffusion chamber, receiving the liquid from said multiplication chamber, for diffusing the liquid, wherein said multiplication chamber has an upstream end opening with a radius which is equal to or larger than the radius of said throat, a downstream end opening with a radius which is equal to or larger than the radius of an upstream end opening of said diffusion chamber, and an intermediate section shaped in a cup-like shape contoured by a convex curve expanded toward the outside of the chamber between said upstream end opening and said downstream end opening, and wherein said diffusion chamber is a conical diffusion chamber.

2. A fluid jet nozzle according to claim 1, wherein said convex curve expanded toward the outside of the chamber between said upstream end opening and said downstream end opening has a maximum value therebetween.

3. A fluid jet nozzle according to claim 1, wherein said fluid jet nozzle is an assemblage of elements forming a portion including said throat and an upstream side construction of said throat, a portion of said multiplication chamber and a portion of said diffusion portion, respectively.

4. A fluid jet nozzle according to claim 1, wherein said liquid is water.

5. A fluid jet nozzle, comprising:

a liquid chamber accommodating therein pressurized liquid;

an orifice communicating with said liquid chamber and through which the liquid from said liquid chamber passes;

a throat communicating with said orifice and through which the liquid from said orifice passes;

a multiplication chamber communicating with said throat and receiving the liquid from said throat for multiplying cavitation in the liquid; and a diffusion chamber, receiving the liquid from said multiplication chamber, for diffusing the liquid;

wherein a plurality of conical diffusion chambers, having different apex angles, respectively, are formed downstream of said throat, said conical diffusion chambers serving as a multiplication chamber and a diffusion chamber.

6. A fluid jet nozzle, comprising:

a liquid chamber accommodating therein pressurized liquid;

an orifice communicating with said liquid chamber and through which the liquid from said liquid chamber passes;

a throat communicating with said orifice and through which the liquid from said orifice passes;

a multiplication chamber communicating with said throat and receiving the liquid from said throat for multiplying cavitation in the liquid; and a diffusion chamber, receiving the liquid from said multiplication chamber, for diffusing the liquid;

wherein said throat has an inner surface formed in one of an annular concavo-convex shape, a parallel thread shape and a tapered thread shape, thereby to provide a cavitation kernel excitor.

7. A fluid jet nozzle, comprising:

a liquid chamber accommodating therein pressurized liquid;

an orifice communicating with said liquid chamber and through which the liquid from said liquid chamber passes;

a throat communicating with said orifice and through which the liquid from said orifice passes;

a cavitation kernel excitor, formed in one of an annular concavo-convex shape, parallel threads and tapered threads, in the inner surface of said throat; and a diffusion chamber, communicating with said throat and receiving the liquid from said throat, for diffusing the liquid.

8. A fluid jet nozzle according to claim 7, wherein said liquid is water.

9. A fluid jet nozzle, comprising:

a liquid chamber accommodating therein pressurized liquid;

an orifice communicating with said liquid chamber and through which the liquid from said liquid chamber passes;

a throat communicating with said orifice and through which the liquid from said orifice passes;

a multiplication chamber communicating with said throat and receiving the liquid from said throat for multiplying cavitation in the liquid; and a diffusion chamber, receiving the liquid from said multiplication chamber, for diffusing the liquid;

wherein said multiplication chamber is formed so that cavitation kernels generated in surrounding liquid between a liquid jet from said throat and an inner wall of said diffusion chamber at a downstream side of said multiplication chamber are temporarily stored and carried out into the liquid jet.

10. A fluid jet nozzle for treating an object metal comprising:

a liquid chamber accommodating therein pressurized liquid;

an orifice communicating with said liquid chamber and through which the liquid from said liquid chamber is contracted and passes;

a throat, having substantially the same diameter Dt over its full length (L) and extending from said orifice in one direction and through which the liquid from said orifice passes at a velocity (V);

a multiplication chamber directly connected to said throat and receiving the liquid from said throat for multiplying cavitation in the liquid; and a diffusion chamber, directly connected to said multiplication chamber and opened in surrounding liquid so as to face an object metal, for diffusing the liquid from said multiplication chamber and directing the diffused liquid including cavitation bubbles to said object metal;

wherein said multiplication chamber has an upstream end opening with a radius which is equal to or larger than the radius of said throat, a downstream end opening with a radius which is equal to or larger than the radius of an upstream end opening of said diffusion chamber, and an intermediate section having a cross-section along an axis of said nozzle having a cup-like shape contoured by a convex curve expanded toward the outside of the chamber between said upstream end opening and said downstream end opening, and wherein said diffusion chamber is a conical diffusion chamber.

11. A fluid jet nozzle according to claim 10, wherein said liquid is water.

* * * * *